US011162394B2

(12) United States Patent
Erickson et al.

(10) Patent No.: US 11,162,394 B2
(45) Date of Patent: Nov. 2, 2021

(54) AUTOMATIC LASH ADJUSTER FOR USE WITH HIGH COMPRESSION INTERNAL COMBUSTION ENGINES

(71) Applicant: DEERE & COMPANY, Moline, IL (US)

(72) Inventors: Neil S. Erickson, Denver, IA (US); Alok N. Pandey, Cedar Falls, IA (US); Eric J. Rego, Fond Du Lac, WI (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/008,317

(22) Filed: Aug. 31, 2020

(65) Prior Publication Data

US 2021/0062686 A1 Mar. 4, 2021

Related U.S. Application Data

(63) Continuation of application No. 16/560,546, filed on Sep. 4, 2019, now Pat. No. 10,794,235.

(51) Int. Cl.
*F01L 1/24* (2006.01)
*F01L 1/047* (2006.01)
(Continued)

(52) U.S. Cl.
CPC ..... *F01L 1/2411* (2013.01); *F01L 1/047* (2013.01); *F01L 1/182* (2013.01); *F01L 1/267* (2013.01);
(Continued)

(58) Field of Classification Search
CPC ... F01L 1/181; F01L 2001/186; F01L 1/2411; F01L 1/2416; F01L 1/267; F01L 1/46; F01L 13/0036; F01L 13/06; F01L 13/08
(Continued)

(56) References Cited

U.S. PATENT DOCUMENTS 6,000,374 A * 12/1999 Cosma ..... F01L 1/38 123/321
2015/0354418 A1 12/2015 Jo et al.

FOREIGN PATENT DOCUMENTS

DE 19630443 A1 1/1998
DE 19710577 A1 9/1998
(Continued)

OTHER PUBLICATIONS

German Search Report issued in counterpart application No. 102020209830.1 dated Mar. 10, 2021 (12 pages).

*Primary Examiner* — Jorge L Leon, Jr.
(74) *Attorney, Agent, or Firm* — Michael Best & Friedrich LLP

(57) ABSTRACT

A hydraulic lash adjuster for use in diesel engines including a cylinder head having a first valve, a second valve, and a valve bridge extending between and in contact with both the first valve and the second valve. Where the diesel engine includes a first rocker arm, and where at least one of the first valve and the second valve undergo an oil can valve deflection rate. The hydraulic lash is configured to selectively transmit force between the first rocker arm and the valve bridge, and where the hydraulic lash adjuster is normally in the open configuration, and where the hydraulic lash adjuster changes from the open configuration to a closed configuration at a critical velocity that is greater than the oil can valve deflection rate.

18 Claims, 5 Drawing Sheets

(51) Int. Cl.

| | |
|---|---|
| ***F01L 1/18*** | (2006.01) |
| ***F01L 13/06*** | (2006.01) |
| ***F02F 1/24*** | (2006.01) |
| ***F02F 1/42*** | (2006.01) |
| ***F01L 1/26*** | (2006.01) |
| ***F01L 13/00*** | (2006.01) |

(52) U.S. Cl.
CPC ..... *F01L 13/0036* (2013.01); *F01L 13/065* (2013.01); *F02F 1/24* (2013.01); *F02F 1/4285* (2013.01); *F01L 2001/186* (2013.01); *F02F 2001/247* (2013.01)

(58) Field of Classification Search
USPC ..... 123/90.16, 90.36, 90.4, 90.44, 90.46
See application file for complete search history.

(56) References Cited

FOREIGN PATENT DOCUMENTS

| | | | |
|---|---|---|---|
| DE | 10017560 | A1 | 10/2001 |
| DE | 102005010711 | A1 | 9/2006 |
| DE | 102007046829 | A1 | 4/2009 |
| EP | 2975230 | A1 | 1/2016 |
| EP | 3653851 | A1 | 5/2020 |

* cited by examiner

AUTOMATIC LASH ADJUSTER FOR USE WITH HIGH COMPRESSION INTERNAL COMBUSTION ENGINES

RELATED APPLICATION

This application is a continuation of U.S. Ser. No. 16/560,546, filed Sep. 4, 2019, the entire content of which is incorporated herein by reference.

FIELD OF THE INVENTION

The present invention relates to a high compression internal combustion engine, and more specifically a high compression internal combustion engine having a valve train with a normally open automatic lash adjuster.

BACKGROUND

High compression internal combustion engines, such as heavy duty diesel engines, use normally closed lash adjusters in their valve trains which can transmit potentially damaging forces through the valve train when valves deform as a result of "oil canning."

SUMMARY

In one aspect, an internal combustion engine including an engine block at least partially defining a cylinder, a piston at least partially positioned within the cylinder and movable with respect thereto, a cylinder head coupled to the engine block and at least partially enclosing the cylinder, the cylinder head defining a first runner open to the cylinder and a second runner open to the cylinder, a first valve mounted to the cylinder head and movable with respect thereto between an open position, in which the first runner is in fluid communication with the cylinder, and a closed position, in which the first runner is fluidly isolated from the cylinder, a second valve mounted to the cylinder head and movable with respect thereto between an open position, in which the second runner is in fluid communication with the cylinder, and a closed position, in which the second runner is fluidly isolated from the cylinder, a valve bridge extending between and in contact with the first valve and the second valve, a first cam lobe with a profile corresponding to positive power operation, a second cam lobe with a profile corresponding to engine braking operation, a first input in operable communication with the first cam lobe and the valve bridge, a second input in operable communication with the second cam lobe and the valve bridge, and a hydraulic lash adjuster positioned between and configured to selectively transmit force between one of the first input and the second input and the valve bridge, and wherein the hydraulic lash adjuster is a normally open lash adjuster.

In another aspect, an internal combustion engine including an engine block defining a cylinder, a piston at least partially positioned within the cylinder and movable with respect thereto, a cylinder head coupled to the engine block and at least partially enclosing the cylinder, the cylinder head defining a first runner open to the cylinder, a first valve mounted to the cylinder head and movable with respect thereto between an open position, in which the first runner is in fluid communication with the cylinder, and a closed position, in which the first runner is fluidly isolated from the cylinder, and where the first valve undergoes an oil can valve deflection rate when the first valve is in the closed position, a first cam lobe, a first input in operable communication with the first cam lobe, and a hydraulic lash adjuster configured to selectively transmit force between the first input and the first valve, wherein the hydraulic lash adjuster is a normally open lash adjuster, and wherein the hydraulic lash adjuster includes a critical velocity greater than the oil can valve deflection rate.

In another aspect, a hydraulic lash adjuster for use in diesel engines including a cylinder head having a first valve, a second valve, and a valve bridge extending between and in contact with both the first valve and the second valve, where the diesel engine includes a first rocker arm, and where at least one of the first valve and the second valve undergo an oil can valve deflection rate, the hydraulic lash adjuster including a body having a first end operably connected to the first rocker arm and a second end opposite the first end operatively connected to the valve bridge, and where the body is configured to selectively transmit force between the first rocker arm and the valve bridge, and where the hydraulic lash adjuster is adjustable between an open configuration and a closed configuration, where the hydraulic lash adjuster is normally in the open configuration, and where the hydraulic lash adjuster changes from the open configuration to the closed configuration at a critical velocity that is greater than the oil can valve deflection rate.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

The disclosure generally relates to a high compression internal combustion engine (e.g., a heavy duty diesel engine) having a valve train assembly operable in both a positive power and engine braking modes of operation. The valve train of the engine includes a valve mounted within a cylinder head that undergoes deformation when the valve is in the closed position, a condition known as oil canning. The deformation is the result of the valve being subject to large pressure forces occurring within the compression chamber due to the relatively high firing or combustion pressures present in diesel engines. In light of this deflection, the valve train includes a normally open hydraulic lash adjuster (HLA) in operable communication with the first valve that has a critical velocity that is greater than the oil can deflection rate but less than the deflection rate produced by the cam as it opens the valve. By doing so, the lash adjuster remains in its open configuration as the oil canning occurs but closes when the valve is opened by the cam. Therefore, the HLA does not transmit the potentially damaging forces generated from the oil canning into the valve train, but does transmit the forces necessary to open the valve for positive power and engine braking operations. This capability is in contrast to existing high compression diesel internal combustion engines where normally closed hydraulic lifters are used that transmit the potentially damaging forces generated during oil canning into the valve train—resulting in excessive wear and premature failure of the engine. Furthermore, existing normally open HLA designs have not been used in high compression engines with engine braking capabilities as the deflection of the valve during oil canning activates the lash adjuster, causing it to become rigid and transmit the undesirable forces into the valve train.

Figure 1:
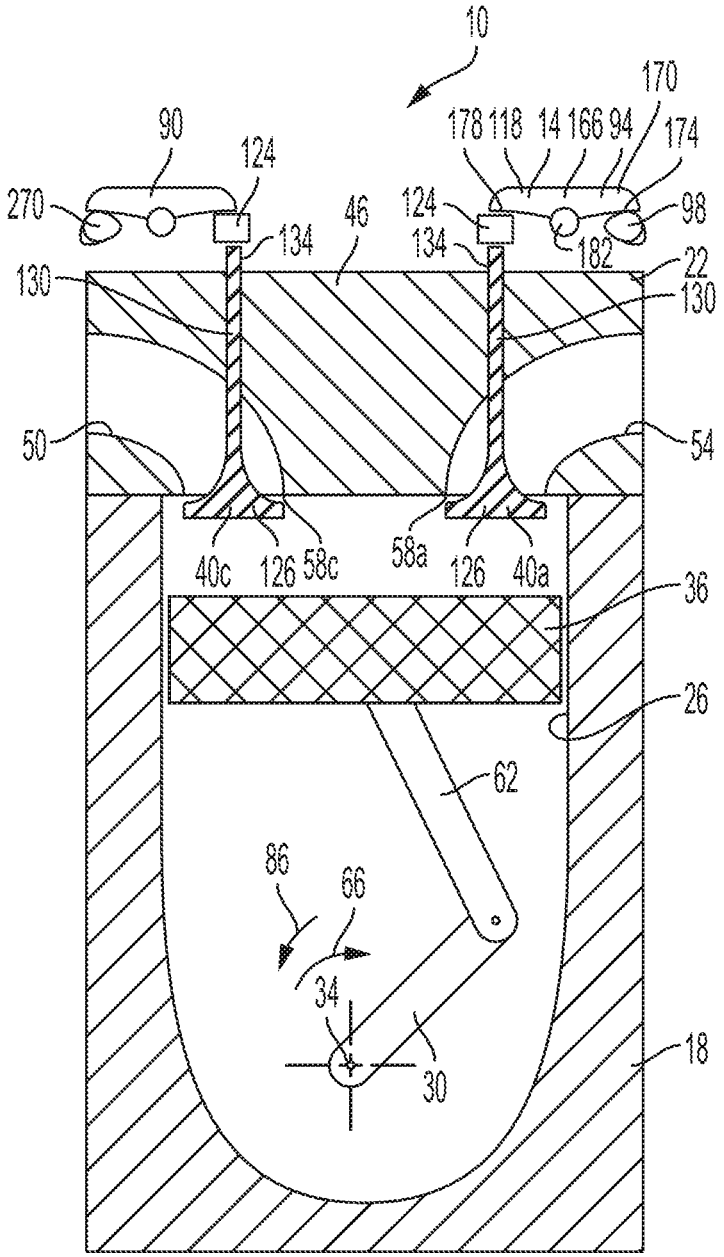
FIG. 1 is a schematic view of an internal combustion engine (ICE) having an improved valve train.

FIG. 1 illustrates an internal combustion engine (ICE) 10 for use with an improved valve train 14 installed thereon. The ICE 10 includes a block 18, a cylinder head 22 coupled to the block 18 to define a cylinder 26 therebetween, and a crank shaft 30 rotatably coupled to the block 18 for rotation bout a crank axis 34. The ICE 10 also includes an improved valve train 14 configured to selectively open and close a plurality of valves 40*a*, 40*b*, 40*c* in fluid communication with the cylinder 26.

As shown in FIG. 1, the cylinder head 22 of the ICE 10 includes a body 46 coupled to the block 18 to at least partially enclose the cylinder 26 therebetween. The body 46 defines an intake runner 50 extending between and in fluid communication with an intake manifold (not shown) and the cylinder 26, and an exhaust runner 54 extending between and in fluid communication with an exhaust manifold (not shown) and the cylinder 26. Although not all are shown, each runner 50, 54, also forms a pair of seats 58*a*, 58*b*, 58*c* open to the cylinder 26 and configured to interact with a corresponding valve 40*a*, 40*b*, 40*c*. In the illustrated implementation, each runner 50, 54 has a two seats 58*a*, 58*b*, 58*c* open to the cylinder 26 (e.g., to produce a four valve head), however in alternative implementations, more or fewer runners and/or seats may be present.

The ICE 10 also includes a piston 36 and a connecting rod 62 as is well known in the art (see FIG. 1). During use, the piston 36 is positioned and reciprocally travels within the cylinder 26 between a top dead center position (TDC), in which the cylinder 26 is located proximate the cylinder head 22, and a bottom dead center position (BDC), in which the cylinder 26 is located away from the cylinder head 22. As is well known in the art, the reciprocating motion of the piston 36 rotates the crank shaft 30 about the crank axis 34 in a first direction of rotation 66 (see FIG. 1). In the illustrated implementation, the ICE 10 is a four-stroke design having an intake stroke 70, a compression stroke 74, an expansion or power stroke 78, and an exhaust stroke 82 as is well known in the art (see FIG. 5A).

During operation, the ICE 10 is operable in a positive power condition (see valve travel path 100 in FIG. 5D), in which the ICE 10 drives the crank shaft 30 in the first direction of rotation 66 (e.g., applies torque to the crank shaft 30 in the first direction 66), and a negative power condition (see valve travel path 104 in FIG. 5D), in which the ICE 10 resists the rotation of the crank shaft 30 and acts as a brake (e.g., applies torque to the crank shaft 30 in a second direction 86 opposite the first direction 66). Stated differently, the positive power condition of the ICE 10 generally correspond with combustion cycle operations while the negative power condition generally corresponds with compression release engine braking operations.

Figure 2:
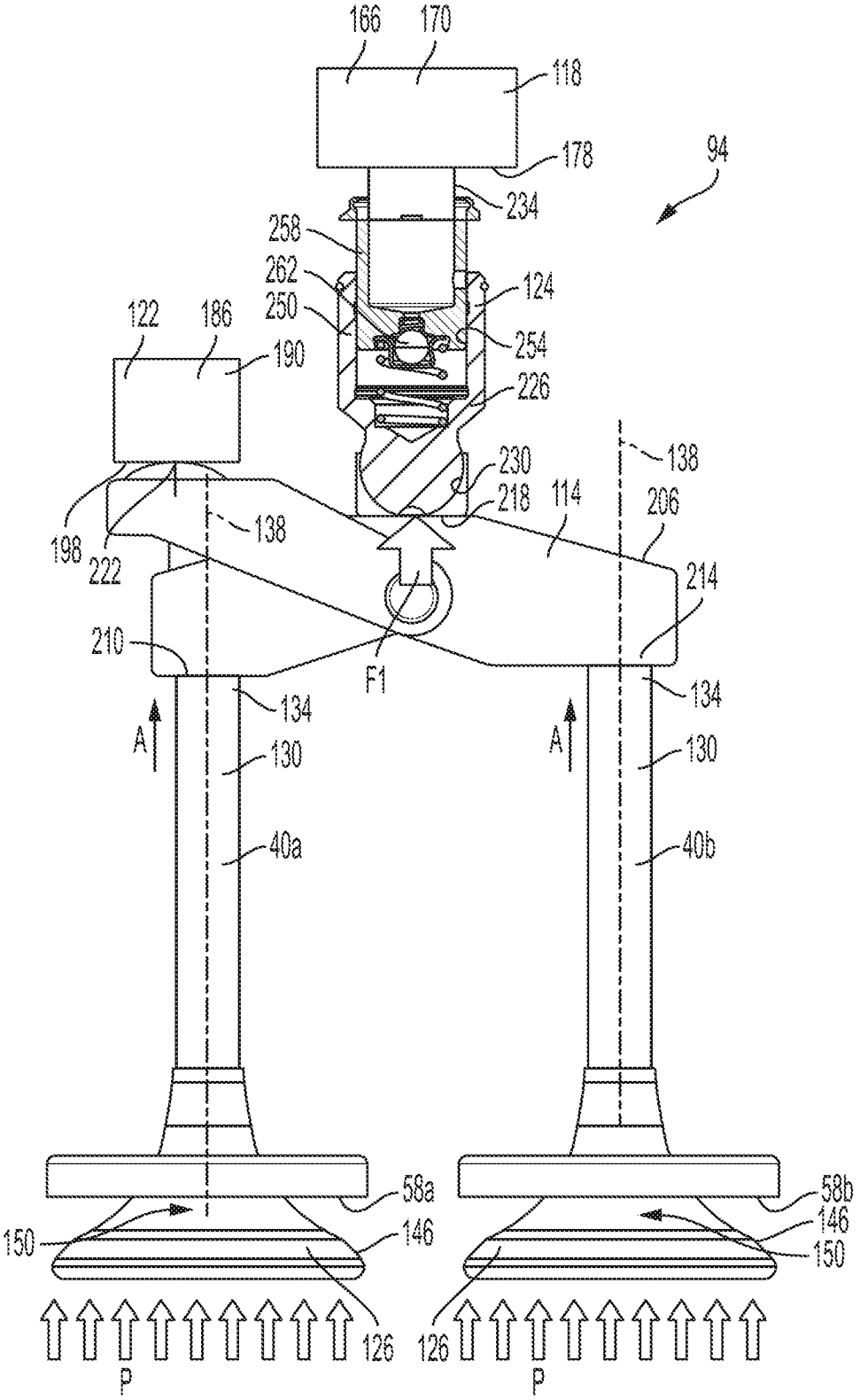
FIG. 2 illustrates the exhaust/braking assembly (EBA) of the valve train of the ICE of FIG. 1.
Figure 3:
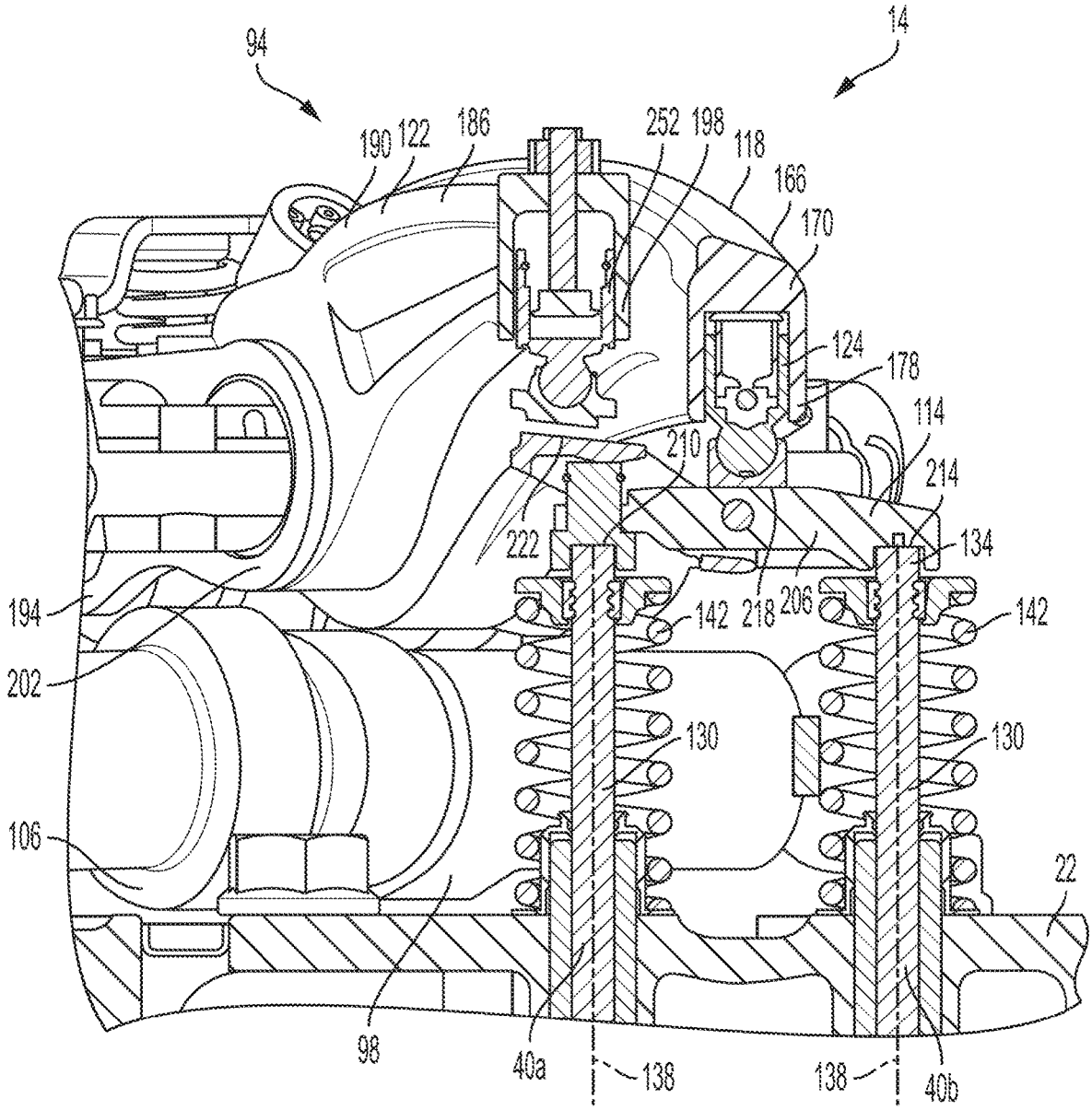
FIG. 3 is a perspective view of the EBA of FIG. 2.

As shown in FIGS. 1-3, the valve train 14 of the ICE 10 includes an intake assembly 90 configured to control the flow of gasses between the cylinder 26 and the intake runner 50, and an exhaust/brake assembly (EBA) 94 configured to control the flow of gasses between the cylinder 26 and the exhaust runner 54. For the purposes of this application, only the EBA 94 will be described in detail herein.

The EBA 94 of the valve train 14 includes a pair of exhaust valves 40*a*, 40*b* selectively engagable with corresponding valve seats 58*a*, 58*b* of the exhaust runner 54, a first cam lobe 98 having a first lift profile 102, a second cam lobe 106 having a second lift profile 110 different than the first lift profile 102, and a fulcrum bridge 114 extending between and engaging both exhaust valves 40*a*, 40*b*. The EBA 94 also includes a first input 118 in operable communication with the first cam lobe 98, a second input 122 in operable communication with the second cam lobe 106, and a lash adjuster (HLA) 124. In the illustrated implementation, the EBA 94 forms a Type III valve train assembly. However, in alternative implementations, the capabilities described herein may be applied to alternative styles of valve train assemblies including, but not limited, to Type I, Type II, Type IV, and Type V.

Both exhaust valves 40*a*, 40*b* of the EBA 94 are substantially similar and include a head 126 configured to selectively engage a corresponding seat 58*a*, 58*b* of the exhaust runner 54, and a stem 130 extending from the head 126 to produce a distal end 134. Each exhaust valve 40*a*, 40*b* also includes a valve axis 138 extending therethrough. During operation, each exhaust valve 40*a*, 40*b* is movably mounted to the cylinder head 22 for movement with respect thereto along the valve axis 138 between a closed position (see FIG. 1), in which the head 126 of the valve 40*a*, 40*b* engages and forms a seal with the corresponding seat 58*a*, 58*b* of the exhaust runner 54 (e.g., to fluidly isolate the cylinder 26 from the exhaust runner 54), and an open position (see FIG. 2), in which the head 126 of the valve 40*a*, 40*b* does not engage the corresponding seat 58*a*, 58*b* (e.g., allowing gasses to flow between the cylinder 26 and the exhaust runner 54). Each exhaust valve 40*a*, 40*b* also includes an exhaust valve spring 142 coupled thereto and configured to bias the valve 40*a*, 40*b* toward the closed position.

During operation, each exhaust valve 40*a*, 40*b* also undergoes a process called "oil canning." Oil canning is where the valve 40*a*, 40*b* is deformed from its natural shape such as a result of the high pressure forces present in the cylinder 26 during the positive power process (e.g., combustion) that cause the distal end 134 to become displaced. More specifically, only the perimeter 146 of the head 126 is in contact with its corresponding seat 58*a*, 58*b* when the exhaust valves 40*a*, 40*b* are in the closed position. As such, the center 150 of the head 126, which is unsupported and spaced away from the perimeter 146, deforms and deflects relative to the perimeter 146 as the pressure (P) acting on the inner surface 152 of the head 126 increases (e.g., during the engine braking process). This deflection, in turn, causes the distal end 134 of the stem 130 to move in a first direction A along the valve axis 138 at a first or oil can valve deflection rate 154 (see FIG. 5D). For the purposes of this application, the oil can valve deflection rate 154 is defined as the rate of speed that the distal end 134 is displaced during the oil canning event. In the illustrated implementation, the exhaust valves 40*a*, 40*b* produce an oil can valve deflection rate 154 of approximately 34 mm/sec, or approximately 35 mm/sec, or approximately 36 mm/sec. However, in alternative implementations, the oil can valve deflection rate 154 may range between approximately 34 mm/sec and approximately 50 mm/sec. In still other implementations, the oil can valve deflection rate 154 may range between approximately 38 mm/sec and approximately 42 mm/sec.

While the illustrated EBA 94 includes two exhaust valves 40*a*, 40*b*. It is to be understood that in alternative implementations one exhaust valve may be present (not shown), or more than two present.

As shown in FIGS. 5A-5D, the first cam lobe 98 of the EBA 94 is in operable communication with the first input 118 and includes a first lift profile 102. The first lift profile 102, in turn, includes timing, duration, and lift that are configured to produce positive power during operation of the ICE 10 (e.g., the first profile 102 accommodates the combustion cycle operations). More specifically, the first cam lobe 98 is configured to cause the first input 118 to open the exhaust valves 40*a*, 40*b* near the beginning of the exhaust stroke 82 and close the exhaust valves 40*a*, 40*b* near the conclusion of the exhaust stroke 82 (see FIG. 5B). In the illustrated implementation, the first lift profile 102 produces a second valve deflection rate 158. The second valve deflection rate 158 is generally defined as the rate at which the exhaust valves 40*a*, 40*b* opens as a result of the first cam lobe 98 (e.g., how fast the valves 40*a*, 40*b* open at the beginning of the exhaust stroke 82). In the illustrated implementation, the second valve deflection rate 158 is greater than the oil can valve deflection rate 154. More specifically, the first cam lobe 98 is configured to produce a second valve deflection rate 158 of approximately 600 mm/sec. In still other implementations, the second valve deflection rate 158 is between approximately 500 mm/sec and 650 mm/sec.

As shown in FIGS. 5A-5D, the second cam lobe 106 of the EBA 94 is in operable communication with the second input 122 and includes a second lift profile 110 that is different than the first lift profile 102. The second lift profile 110, in turn, includes timing, duration, and lift, all of which are configured to produce negative power during operation of the ICE 10 (e.g., the second profile 110 accommodates the compression release engine braking operations). For example, the second lift profile 110 is configured to cause the second input 122 to open one or more of the exhaust valves 40*a*, 40*b* in the later stages of the compression stroke 74 and close the one or more exhaust valves 40*a*, 40*b* at approximately the beginning of the expansion stroke 78 (see FIG. 5C). In the illustrated implementation, the second lift profile 110 produces a third valve deflection rate 162. The third valve deflection rate 162 is generally defined as the rate at which the exhaust valves 40*a*, 40*b* open as a result of the second cam lobe 106 (e.g., how fast the valves 40*a*, 40*b* open at the end of the compression stroke 74). In the illustrated implementation, the third valve deflection rate 162 is greater than the oil can valve deflection rate 154. More specifically, the second cam lobe 106 is configured to produce a third valve deflection rate 162 of approximately 450 mm/sec. In still other implementations, the third valve deflection rate 162 is between approximately 400 mm/sec and 500 mm/sec.

As shown in FIGS. 1-3, the first input 118 is in operable communication with and extends between the first cam lobe 98 and the fulcrum bridge 114 to transmit forces therebetween. More specifically, the first input 118 includes a first rocker arm 166 having an elongated body 170 with a first contact point 174, a second contact point 178 opposite the first contact point 174, and a pivot 182 located between the first contact point 174 and the second contact point 178. When assembled, the first rocker arm 166 is pivotally coupled to the cylinder head 22 at the pivot 182 such that the first contact point 174 is operatively engaged with the first cam lobe 98 (e.g., in contact with) and the second contact point 178 is operatively engaged with the fulcrum bridge 114 (e.g., via the HLA 124).

During use, inputs from the first cam lobe 98 (e.g., changes in cam diameter) are transmitted to the exhaust valves 40*a*, 40*b* (e.g., via the fulcrum bridge 114) by pivoting the first rocker arm 166 about its pivot 182. More specifically, the first rocker arm 166 is configured to interact with the fulcrum bridge 114 such that inputs from the first cam lobe 98 actuate both exhaust valves 40*a*, 40*b* together (described below). While the illustrated rocker arm 166 acts on both valves 40*a*, 40*b* via the HLA 124 and fulcrum bridge 114, in alternative implementations, the second contact point 178 of the first rocker arm 166 may operably interact with the valves 40*a*, 40*b* directly or through other type of linkage (not shown).

As shown in FIGS. 2 and 3, the second input 122 is in operable communication with and extends between the second cam lobe 106 and the fulcrum bridge 114 to transmit forces therebetween. More specifically, the second input 122 includes a second rocker arm 186 having an elongated body 190 with a first contact point 194, a second contact point 198 opposite the first contact point 194, and a pivot 202 located between the first contact point 194 and the second contact point 198. When assembled, the second rocker arm 186 is pivotally coupled to the cylinder head 22 at the pivot 202 such that the first contact point 194 is operatively engaged with the second cam lobe 106 (e.g., in contact with) and the second contact point 198 is operatively engaged with the fulcrum bridge 114. During use, inputs from the second cam lobe 106 (e.g., changes in cam diameter) are transmitted to one of the two exhaust valves 40*a*, 40*b* (e.g., via the fulcrum bridge 114) by pivoting the second rocker arm 186 about its pivot 202. While the illustrated rocker arm 186 acts on a single exhaust valve 40*a* via a fulcrum bridge 114, in alternative implementations, the second end 198 of the second rocker arm 186 may operably interact with the valve 40*a* either directly or through other types of linkage (not shown). For example, the rocker arm 186 may include a hydraulic plunger 252 to transmit force between the rocker arm 186 and the fulcrum bridge 114. In still other implementations, the hydraulic plunger 252 may be replaced with a normally open HLA 124 (not shown) as described below. Furthermore, in alternative implementations, the second rocker arm 186 may be configured to actuate both exhaust valves 40*a*, 40*b*.

As shown in FIGS. 2 and 3, the fulcrum bridge 114 of the EBA 94 includes an elongated and rigid body 206 having a first contact point 210, a second contact point 214, a third contact point 218 positioned between the first contact point 210 and the second contact point 214, and a fourth contact point 222 that is not positioned between the first contact point 210 and the second contact point 214 (e.g., outside the region between the first contact point 210 and the second contact point 214). When the EBA 94 is assembled, the first contact point 210 directly engages the distal end 134 of the first exhaust valve 40*a* and the second contact point 214 directly engages the distal end 134 of the second exhaust valve 40*b*. Furthermore, the third contact point 218 is in operable communication with the first input 118 (e.g., via the HLA 124, described below), and the fourth contact point 222 is in operable communication with the second input 122. During use, the relative locations of the four contact points 210, 214, 218, 222 are configured such that applying force to the third contact point 218 causes both exhaust valves 40*a*, 40*b* to open while applying force to the fourth contact point 222 causes only the first exhaust valve 40*a* to open.

Furthermore, the fourth contact point 222 is located such that applying a force thereto causes a reaction force (F1) to be applied to the first input 118 via the third contact point 218 (e.g. via the HLA 124; see FIG. 2).

Figure 4:
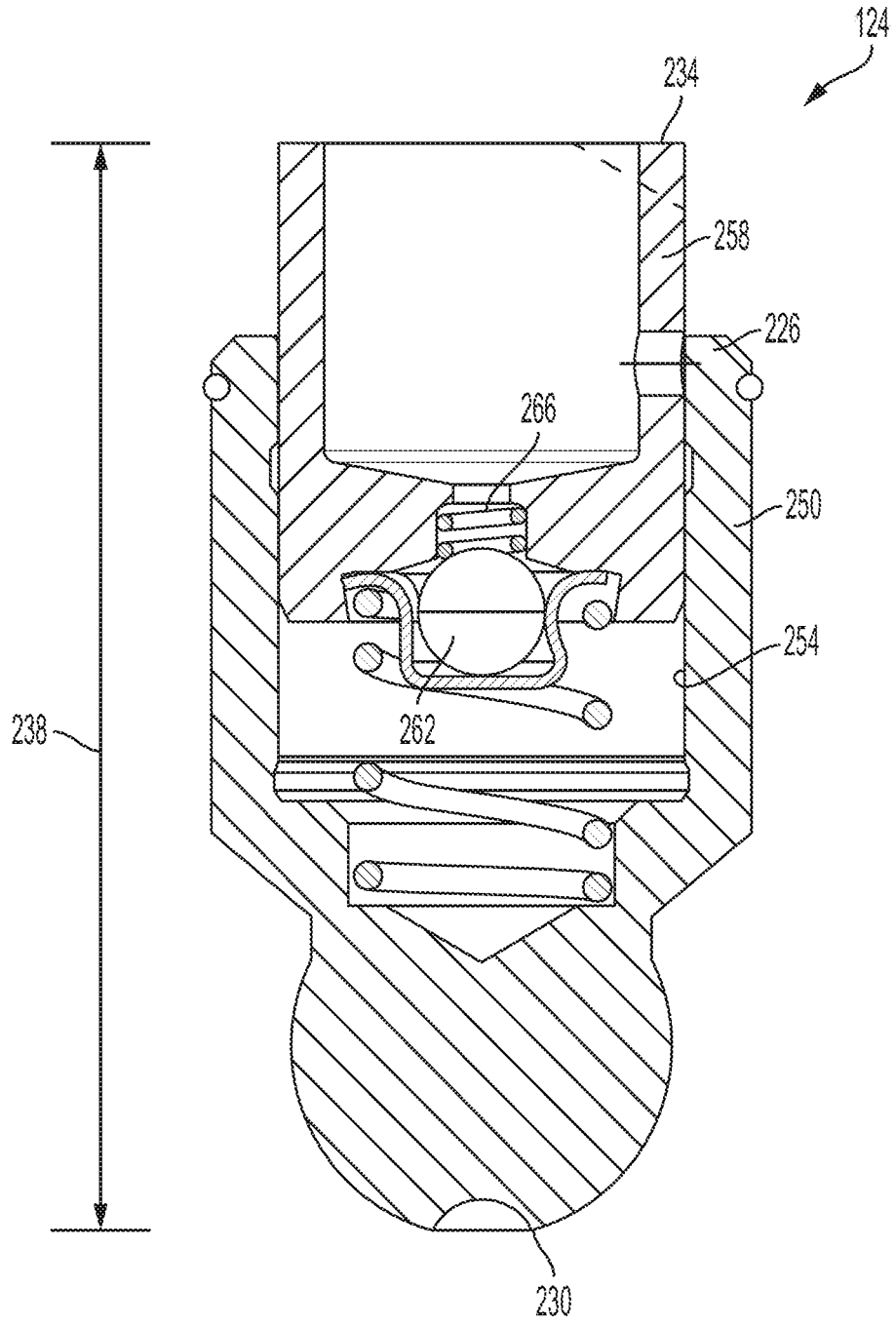
FIG. 4 is a middle section view of a hydraulic lash adjuster of the EBA of FIG. 2.

As shown in FIGS. 2-4, the HLA 124 is positioned between and configured to selectively transmit forces between the second contact point 178 of the first input 118 and the exhaust valves 40*a*, 40*b* via the fulcrum bridge 114. More specifically, the HLA 124 is a normally-open lash adjuster having a body 226 with a first end 230, and a second end 234 opposite the first end 230. Together, the first end 230 and the second end 234 define a lash adjuster length 238 therebetween.

The HLA 124 is adjustable between a closed configuration, in which the first end 230 is fixed relative to the second end 234 (e.g., the adjuster length 238 is fixed), and an open configuration, in which the first end 230 is movable relative to the second end 234 (e.g., the adjuster length 238 is variable). During use, the HLA 124 is normally in the open configuration and only transitions to the closed configuration when the relative velocity between the first end 230 and the second end 234 (hereinafter the "HLA velocity") exceeds a pre-determined value—herein referred to as the critical velocity. In the illustrated implementation, the critical velocity of the HLA 124 is greater than the oil can deflection rate 154 but less than the second valve deflection rate 158 of the first cam lobe 98. By placing the critical velocity within the above described range, the HLA 124 remains open when oil canning occurs but closes when the valve 30*a*, 40*b* is required to open. Therefore the potentially damaging forces produced by oil canning are not transmitted back into the valve train 14 but the valves 40*a*, 40*b* can still be opened as required for positive power and engine braking operations. In the illustrated implementation, the critical velocity of the HLA 124 is approximately 40 mm/sec at 130° C. engine oil temperature. In still other implementations, the critical velocity is between approximately 34 mm/sec and approximately 44 mm/sec. In still other implementations, the critical velocity is greater than approximately 34 mm/sec.

In the illustrated implementation, the body 226 of the HLA 124 includes a first body portion 250 at least partially defining a chamber 254 therein, a second body portion 258 at least partially positioned and movable within the chamber 254, and a check valve 262 to selectively control the flow of fluid (e.g., oil) into and out of the chamber 254. As shown in FIG. 4, the first body portion 250 defines the first end 230, the second body portion 258 defines the second end 234, and relative movement between the first body portion 250 and the second body portion 258 cause the size of the chamber 254 and the adjuster length 238 to change. More specifically, removing the second body portion 258 from the chamber 254 causes the chamber size to increase and the adjuster length 238 to increase while inserting the second body portion 258 further into the chamber 254 causes the chambers size to decrease and the adjuster length 238 to decrease.

The check valve 262 of the HLA 124 is adjustable between an open position, in which a check ball is not engaged with its corresponding seat such that fluid can enter and exit the chamber 254, and a closed position, in which the check ball is engaged with its corresponding seat and fluid generally does not enter and exit the chamber 254. The check valve 262 also includes a biasing member 266 (e.g., a spring) configured to bias the check valve 262 in the open position. Furthermore, the attributes of the biasing member 266 are such that they produce the desired critical velocity. When the check valve 262 is in the closed position, as a result the first body portion 250 is fixed relative to the second body portion 258 causing the adjuster length 238 to be effectively fixed (e.g., the HLA 124 is in the closed configuration). In contrast, when the check valve 262 is in the open position (e.g., fluid is able to enter and exit the chamber 254), the first body portion 250 is movable relative to the second body portion 258 causing the adjust length 238 to be variable (e.g., the HLA 124 is in the closed configuration).

While the illustrated implementation discloses a normally open HLA 124 positioned between the first rocker arm 166 and the fulcrum bridge 114, it is to be understood that the HLA 124 may be re-positioned within the valve train 14 as necessary to accommodate different valve train types. For example, in instances where no fulcrum bridge 114 is present, the HLA 124 may extend between the first rocker arm 166 and the valve 40*a*, 40*b* (not shown). In still other implementations where no rocker arms are present, the HLA 124 may be positioned between the first cam lobe 98 and the valves 40*a*, 40*b* or the first cam lobe 98 and the fulcrum bridge 114.

Still further, while the illustrated second input 122 acts directly on the fulcrum bridge 114 with no HLA 124 present, it is to be understood that in alternative implementations, an HLA 124 may be used to selectively transmit forces therebetween as well. In such implementations, the HLA 124 would have a critical velocity that is greater than the oil can valve deflection rate 154 and less than the third valve deflection rate 162.

While not described in detail herein, it is to be understood that an HLA 124 as described above may also be incorporated into the intake assembly 90 to aid the opening and closing of the intake valves 40*c* (see FIG. 1). In such implementations, the layout of the intake assembly 90 would be substantially similar to the layout of the EBA 94. The intake valves 40*c* would define an "intake oil can valve deflection rate" specific to the intake valve 40*c* designs and an "intake second valve deflection rate" specific to the cam profile of the intake cam lobe 270. Furthermore, the HLA 124 incorporated into the intake assembly 90 would have a critical velocity that is greater than the intake oil cam valve deflection rate and less than the intake second valve deflection rate.

Figures 5A, 5B, 5C, 5D:
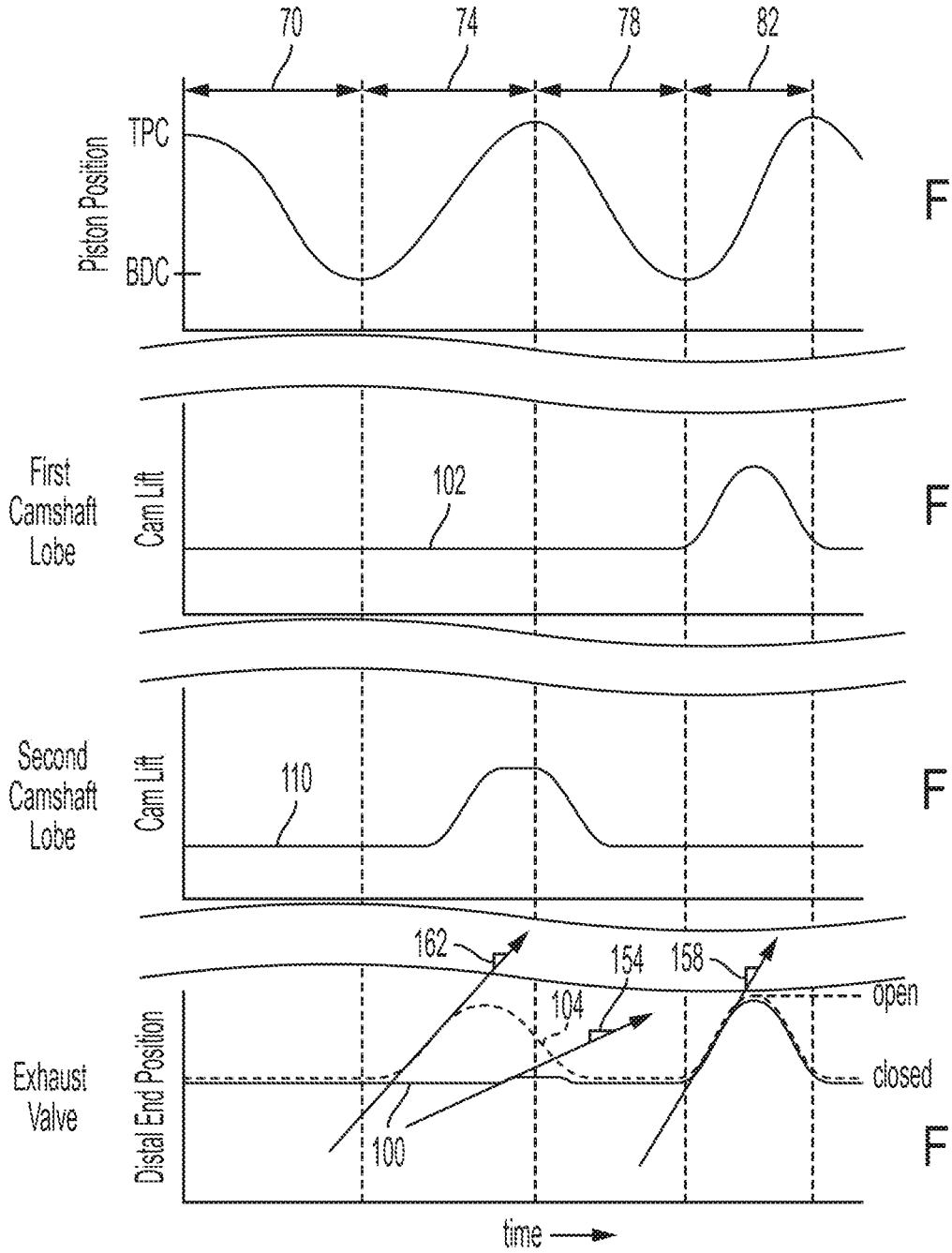
FIGS. 5A-5D illustrate cam and piston tracking information of the ICE of FIG. 1.

During positive power operation of the ICE 10, the ICE undergoes standard four-stroke combustion cycle as is well known in the art (see FIG. 5A and valve travel path 100 in FIG. 5D). More specifically, the piston 36 reciprocally travels within the cylinder 26 between TDC and BDC during the intake stroke 70, compression stroke 74, power stroke 78, and exhaust stroke 82 causing the crank shaft 30 to rotate about the crank axis 34 in the first direction of rotation 66. Only the aspects of the combustion process relevant to the operation of the HLA 124 will be described in detail herein.

During the compression stroke 74, the exhaust valves 40*a*, 40*b* are in the closed position. As the piston 36 travels from BDC toward TDC, the piston 36 compresses the air within the cylinder 26 causing the pressure within the cylinder 26 to increase. As the pressure increases within the cylinder 26, the pressure is exerted against the inner surface 152 of both valves 40*a*, 40*b* causing them to deform (e.g., undergo the oil canning process; described above). More specifically, the center 150 of the head 126 deflects relative to the perimeter 146 causing the distal end 134 of the stem 130 of both valves 40*a*, 40*b* to move in the first direction A at the oil can valve deflection rate 154 (see FIG. 5D).

The resulting movement of the distal ends 134 of both exhaust valves 40*a*, 40*b* are exerted against the fulcrum bridge 114 at the first and second contact points 210, 214. This causes the fulcrum bridge 114 to also travel at the oil can valve deflection rate 154 in the first direction A. As a result, the fulcrum bridge 114 exerts the force and motion into the HLA 124 via the third contact point 218, again at the oil can valve deflection rate 154. Since the oil can valve deflection rate 154 is below the critical velocity of the HLA 124 (described above), the HLA 124 remains in the open position (e.g., the check valve 262 remains open). Since the HLA 124 is open, the second end 234 in contact with the fulcrum bridge 114 is able to move relative to the first end 230 in contact with the first input 118 such that little to no force is transmitted to the first input 118. As such, the movement and force created by the oil canning process is not transmitted to the first input 118 or the remainder of the valve train 14.

During the exhaust stroke 82, the exhaust valves 40*a*, 40*b* begin in the closed position. As the first cam lobe 98 rotates the first lift profile 102 is configured to provide an input (e.g., lift) to the first rocker arm 166 (e.g., the first input 118). This input, in turn, causes the first rocker arm 166 to rotate about its pivot 182 and exert a force against the third contact point 218 of the fulcrum bridge 114 via the HLA 124. As described above, the first lift profile 102 is configured to bias the valves 40*a*, 40*b* toward the open position at the second valve deflection rate. Since the second valve deflection rate is greater than the critical velocity, the HLA 124 transitions into the closed configuration (e.g., the check valve 262 closes). By doing so, the first end 230 of the HLA 124 is fixed relative to the second end 234 and the movement of the first rocker arm 166 is directly transmitted to the fulcrum bridge 114. As such, the movement and force created by the first cam lobe 98 to open the exhaust valves 40*a*, 40*b* are transmitted to the valves themselves.

During engine braking operation of the ICE 10 (see valve travel path 104 of FIG. 5D), the second cam lobe 106 provides inputs to the valve train 14. More specifically, late in the compression stroke 74 the second lift profile 110 is configured to provide an input (e.g., lift) to the second rocker arm 186 (e.g., the second input 122). This input, in turn, causes the second rocker arm 186 to rotate about its pivot 202 and exert a force against the fourth contact point 222 of the fulcrum bridge 114. Due to the relative position of the fourth contact point 222 (e.g., not between the first and second contact points 210, 214), the force applied by the second rocker arm 186 causes only the first exhaust valve 40*a* to open and exerts a reaction force (F1) against the HLA 124 via the third contact point 218 (see FIG. 2). By doing so, the HLA 124 remains under compression even during the engine braking operations and therefore does not inadvertently extend, a process known as "jacking."

Various features of the disclosure are set forth in the following claims.

The invention claimed is:

1. An internal combustion engine comprising:

an engine block at least partially defining a cylinder;

a piston at least partially positioned within the cylinder and configured to move with respect to the cylinder;

a cylinder head coupled to the engine block and at least partially enclosing the cylinder, the cylinder head defining a first runner open to the cylinder and a second runner open to the cylinder;

a first valve mounted to the cylinder head and configured to move between an open position, in which the first runner is in fluid communication with the cylinder, and a closed position, in which the first runner is fluidly isolated from the cylinder;

a second valve mounted to the cylinder head and configured to move between an open position, in which the second runner is in fluid communication with the cylinder, and a closed position, in which the second runner is fluidly isolated from the cylinder;

a valve bridge extending between and in contact with the first valve and the second valve;

a first cam lobe with a profile corresponding to positive power operation;

a second cam lobe with a profile corresponding to an engine braking operation; and a hydraulic lash adjuster configured to selectively transmit force between the valve bridge and one of the first cam lobe and the second cam lobe, wherein the hydraulic lash adjuster is a normally open lash adjuster.

2. The internal combustion engine of claim 1, wherein the internal combustion engine is a diesel engine.

3. The internal combustion engine of claim 1, further comprising a rocker arm configured to transmit force between the first cam lobe and the hydraulic lash adjuster.

4. The internal combustion engine of claim 1, further comprising a rocker arm configured to transmit force between the second cam lobe and the hydraulic lash adjuster.

5. The internal combustion engine of claim 1, wherein at least one of the first valve and the second valve undergoes an oil can valve deflection rate, and wherein the hydraulic lash adjuster has a critical velocity greater than the oil can valve deflection rate.

6. The internal combustion engine of claim 5, wherein the oil can valve deflection rate is approximately 34 mm/sec.

7. The internal combustion engine of claim 5, wherein the oil can valve deflection rate is between approximately 34 mm/sec and approximately 50 mm/sec.

8. The internal combustion engine of claim 1, wherein the hydraulic lash adjuster has a critical velocity greater than 34 mm/sec.

9. The internal combustion engine of claim 1, wherein the hydraulic lash adjuster has a critical velocity of approximately 40 mm/sec.

10. The internal combustion engine of claim 1, wherein the first valve and the second valve are exhaust valves.

11. An internal combustion engine comprising:

an engine block defining a cylinder;

a piston at least partially positioned within the cylinder and configured to move with respect to the cylinder;

a cylinder head coupled to the engine block and at least partially enclosing the cylinder, the cylinder head defining a first runner open to the cylinder;

a first valve mounted to the cylinder head and movable between an open position, in which the first runner is in fluid communication with the cylinder, and a closed position, in which the first runner is fluidly isolated from the cylinder, and wherein the first valve undergoes an oil can valve deflection rate when the first valve is in the closed position;

a first cam lobe; and a hydraulic lash adjuster configured to selectively transmit force between the first cam lobe and the first valve, wherein the hydraulic lash adjuster is a normally open lash adjuster, and wherein the hydraulic lash adjuster includes a critical velocity greater than the oil can valve deflection rate.

12. The internal combustion engine of claim 11, wherein the first valve is an exhaust valve.

13. The internal combustion engine of claim 11, wherein the oil can valve deflection rate is approximately 34 mm/sec.

14. The internal combustion engine of claim 11, wherein the cylinder head defines a second runner open to the cylinder, and wherein the internal combustion engine further comprises:

a second valve mounted to the cylinder head and movable between an open position, in which the second runner is in fluid communication with the cylinder, and a closed position, in which the second runner is fluidly isolated from the cylinder; and a valve bridge extending between and in contact with the first valve and the second valve.

15. The internal combustion engine of claim 14, wherein the hydraulic lash adjuster is configured to selectively transmit force between the first cam lobe and the valve bridge.

16. The internal combustion engine of claim 11, wherein the internal combustion engine is a diesel engine.

17. A hydraulic lash adjuster for use in diesel engines including a cylinder head having a first valve that undergoes an oil can valve deflection rate, and a first cam lobe configured to produce a first valve deflection rate, the hydraulic lash adjuster comprising:

a body having a first end operably connected to the first cam lobe, and a second end operatively connected to the first valve, and wherein the body is configured to selectively transmit force between the first cam lobe and the first valve; and wherein the hydraulic lash adjuster configured to adjust between an open configuration and a closed configuration, wherein the hydraulic lash adjuster is normally in the open configuration, and wherein the hydraulic lash adjuster changes from the open configuration to the closed configuration at a critical velocity that is greater than the oil can valve deflection rate and less than the first valve deflection rate.

18. The hydraulic lash adjuster of claim 17, wherein the critical velocity is approximately 40 mm/sec.

* * * * *